US006961970B2

(12) United States Patent
Pedersen

(10) Patent No.: US 6,961,970 B2
(45) Date of Patent: Nov. 8, 2005

(54) FILLED BEDDING CONSTRUCTION HAVING CHANNELS WITH ALTERNATING LENGTH PORTIONS

(75) Inventor: Samuel B. Pedersen, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 10/808,637

(22) Filed: Mar. 25, 2004

(65) Prior Publication Data

US 2005/0210586 A1 Sep. 29, 2005

(51) Int. Cl.[7] ..... A47G 9/02
(52) U.S. Cl. ..... 5/502; 5/486
(58) Field of Search ..... 5/502, 500, 486, 5/485, 482, 691, 690

(56) References Cited

U.S. PATENT DOCUMENTS

| | | | | | |
|---|---|---|---|---|---|
| 429,894 | A | * | 6/1890 | Doremus | 5/502 |
| 1,394,061 | A | * | 10/1921 | Bernstein | 5/690 |
| 2,087,505 | A | * | 7/1937 | Davis | 5/502 |
| 2,248,768 | A | * | 7/1941 | Licht | 5/485 |
| 2,263,810 | A | * | 11/1941 | Leslie et al. | 5/502 |
| 2,399,235 | A | * | 4/1946 | Leslie | 5/502 |
| 2,878,481 | A | * | 3/1959 | Siminow | 112/400 |
| 4,426,945 | A | * | 1/1984 | A-Yan | 112/475.08 |
| 4,707,873 | A | * | 11/1987 | A-Yan | 5/502 |
| 4,748,703 | A | * | 6/1988 | Emi et al. | 5/502 |
| 4,839,934 | A | * | 6/1989 | Rojas | 5/502 |
| 5,187,825 | A | * | 2/1993 | Tesch | 5/502 |
| 5,199,121 | A | * | 4/1993 | Payne | 5/502 |
| 5,299,333 | A | * | 4/1994 | Pedersen et al. | 5/502 |
| 5,557,816 | A | * | 9/1996 | Pedersen et al. | 5/645 |
| 5,720,058 | A | * | 2/1998 | Hollander et al. | 5/502 |
| 5,987,669 | A | * | 11/1999 | Leggett et al. | 5/502 |
| 6,009,579 | A | * | 1/2000 | Pedersen | 5/690 |

* cited by examiner

*Primary Examiner*—Robert G. Santos
(74) *Attorney, Agent, or Firm*—Jensen & Puntigam P.S.

(57) ABSTRACT

The bedding article comprises a plurality of channels which extend longitudinally or laterally of the featherbed and into which fill can be blown. Each channel is divided into two longitudinal portions, accomplished by a line of lateral stitching across the channel. The two portions have different lengths, with the two lengths alternating from end to end for adjacent channels.

12 Claims, 2 Drawing Sheets

10
22
14
12
16
18

22
20
32
31
31
31
19
14
24

40
44
46
42
46
48
50
50
32

61
60
60
58
63

68
70
71
71
71
71
71

72
74
74
74
74
74
73
73
73
73
73

FILLED BEDDING CONSTRUCTION HAVING CHANNELS WITH ALTERNATING LENGTH PORTIONS

TECHNICAL FIELD

This invention relates generally to featherbed construction, and more particularly concerns a featherbed having a channel construction.

BACKGROUND OF THE INVENTION

In general, filled bedding products, including featherbeds, are designed to provide increased comfort for sleeping. A variety of materials can be used for filling, although featherbeds are typically filled with water fowl (goose or duck) feathers. Featherbeds are usually positioned on top of the modern bed mattress and are typically much thicker than a traditional mattress pad, so as to provide additional comfort. In addition to comfort, however, featherbeds give the bed a consistent fluffy and inviting look.

Featherbeds have various sewing constructions, including a channel arrangement which runs the entire length or the entire width, i.e. from side to side, of the featherbed. Channel construction can also include baffles, which are fabric elements which extend between the top and bottom fabric layers of the featherbed within the individual channels. The channel/baffle construction basically divides the featherbed geometrically into a pattern of squares.

Other sewing constructions used with featherbeds include stitch sewing, which can include various sewn patterns, such as squares, diamonds or other shapes, and which individually connect the top and bottom fabric layers of the featherbed but are not connected together to form a continuous or repeating pattern.

Frame construction for featherbeds comprises channels sewn along the outer sides and across the top and/or bottom of the featherbed. Frame construction can be combined with sewn patterns if desired.

There are disadvantages to all of the above sewing constructions. Channel construction without baffles, as well as stitch sewing and frame sewing, allow the feathers within the featherbed to readily move or shift within the featherbed during typical use. Feathers ordinarily will shift to the top and/or bottom of the featherbed. The featherbed will as a result look uneven and its comfort will be compromised. While this can be remedied by fluffing and physical shifting of the featherbed, this is often inconvenient to do on a daily basis.

With the baffle construction, which is the most popular sewing construction for featherbeds, the baffle squares have an opening which runs along one edge of the baffle fabric wall inside the featherbed to allow for filling (blowing-in) of the individual squares. This is well-known in the industry. However, these "blow holes" in the baffles remain open after the filling is completed (there is no convenient way of closing the openings) and feathers will eventually migrate out of the individual squares into adjacent ones in use of the featherbed. This results in an uneven look and diminished performance, which cannot be corrected by fluffing because the feathers cannot be forced back into the squares from which they have migrated.

Hence, all featherbeds with the above variety of construction designs suffer from performance and appearance disadvantages, and the necessity of fluffing maintenance, caused by migration of feathers during use. It would be advantageous if a featherbed construction could significantly prevent/reduce such feather migration resulting from normal use.

SUMMARY OF THE INVENTION

Accordingly, the present invention is a bedding article, comprising: a plurality of bedding channels into which fill can be blown, wherein at least a majority of the channels are divided into two longitudinal portions by a closing element; and filling in the two portions of each channel.

BEST MODE FOR CARRYING OUT THE INVENTION

The bedding construction of the present invention is useful particularly for featherbeds, but may also be useful in other bedding products which use a fill of some kind. The present construction involves a new channel arrangement, with a stitching or other closure across each channel so that each channel comprises two completely closed, separate sections. Generally, the individual channels extend longitudinally for the length of the featherbed, laterally across the full width of the featherbed, or diagonally across the featherbed. The resulting channels can also have a baffle construction, as in conventional featherbeds.

Figures 1A, 1B, 2A, 2B, 3A, 3B:
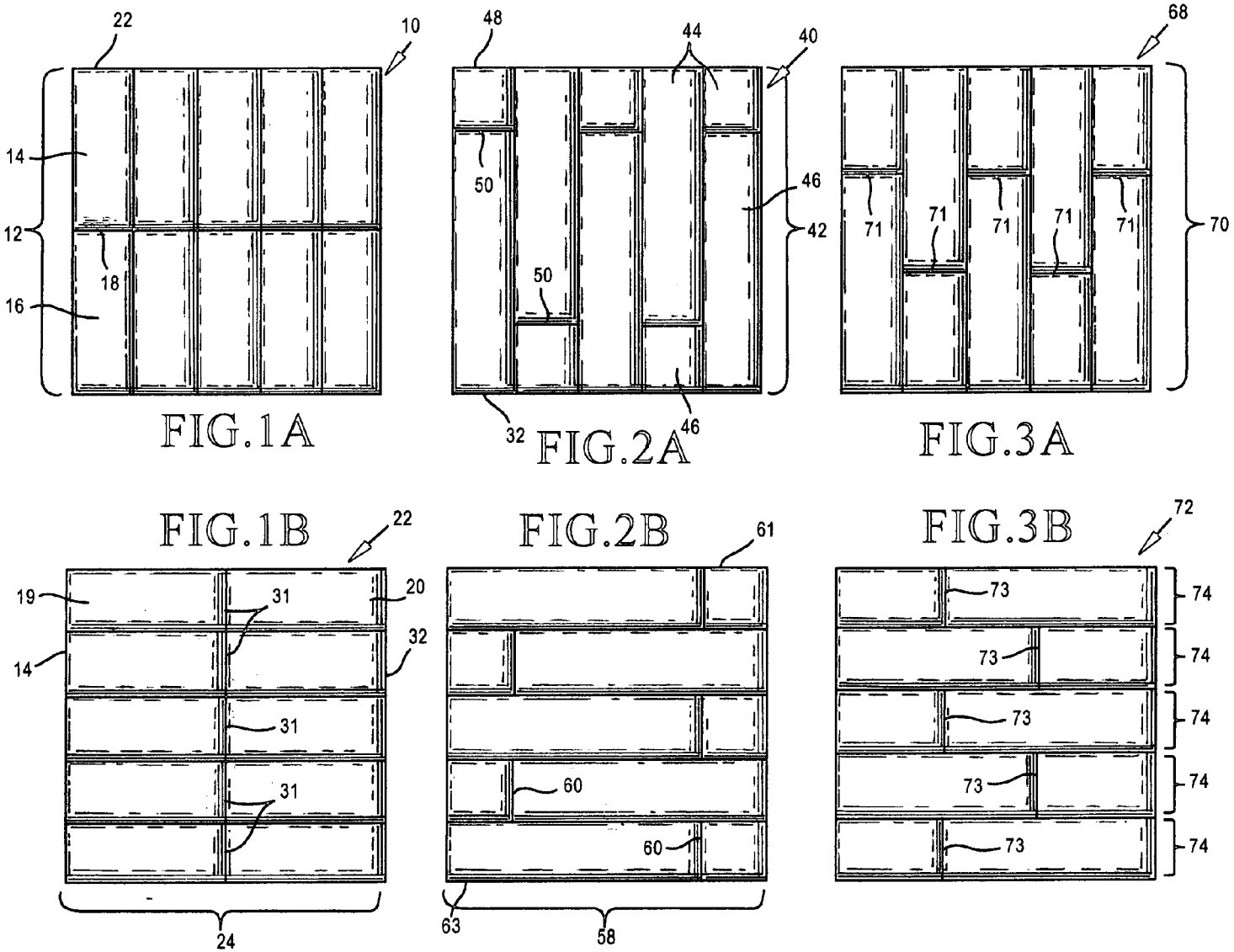
FIGS. 1A and 1B show one embodiment of the comforter channel construction of the present invention, for longitudinal channels and for lateral channels, respectively.
FIGS. 2A and 2B show another embodiment of the present invention with an 80%–20%/20%–80% alternating channel construction, for longitudinal and lateral channels, respectively.
FIGS. 3A and 3B show a further embodiment using a ⅔–⅓ and ⅓–⅔ arrangement for longitudinal and lateral channel constructions, respectively.

The placement of the cross-closure, which can be accomplished by sewing or other closing means, can be made at various locations along the channel. FIGS. 1A and 1B show a 50%–50% arrangement for both longitudinal (FIG. 1A) and horizontal (FIG. 1B) channel embodiments. In FIG. 1A, featherbed 10 includes a plurality of longitudinal side-by-side channels 12—12. Each channel 12 extends for the full length of the featherbed 10. Each channel 12 is divided into two equal length portions 14 and 16 by a cross-closure member 18. After the cross-closure has been completed, the individual portions 14 and 16 in all channels 12—12 can be filled from opposing ends 20 and 22. The filling can be natural feathers or down or a combination thereof, or the filling could be synthetic, such as polyester or other synthetic material.

FIG. 1B shows a featherbed 22 in which the individual, separate channels 24—24 extend horizontally across the featherbed. Each channel 24 is divided into equal length portions 29 and 30 by a closure line such as stitching line 31. Again, each channel is filled by conventional blowing-in of filling from both ends 32 and 34 of the successive channels.

The bedding construction of FIGS. 1A and 1B, involving the division of the channels into two separate portions by a cross-closure, such as by sewing, operates to hold the filling, e.g. feathers, in place within the two portions of each channel, preventing the migration of the filling to one end or the other of the channel. With the feathers held generally in place by the construction of FIGS. 1A and 1B, a consistent overall "fluffy" look is maintained and the comfort potential of the featherbed is maximized.

The effective reduction in the "length" of the individual channels by dividing them into two portions prevents the feathers in each portion from shifting to the very ends of a longitudinal channel or a horizontal channel. The construction of FIGS. 1A and 1B can also have "sewn through" patterns or include baffle elements. The care of a featherbed with the construction of FIGS. 1A and 1B is thus significantly reduced to just a daily short fluffing to loft the feathers to their maximum amount and even out the filling within each portion of the channels.

The channel construction of FIGS. 1A and 1B, however, i.e. with the cross-closure line at the middle of each channel, may form a "valley" region in the very middle of the featherbed, with less filling, reducing the comfort in that region. The arrangement of FIGS. 2A and 2B and the other figures eliminates this disadvantage. FIGS. 2A and 2B show the basic "two portion" channel construction of FIGS. 2A and 1B, except that the cross-closure line for each channel alternates between 80% and 20% location along the length of the channel.

FIG. 2A shows an alternating 80%–20% arrangement for longitudinal channels, while FIG. 2B shows an alternating 80%–20% arrangement for horizontal channels. In FIG. 2A, in particular, featherbed 40 includes a plurality of channels 42—42. Each channel 42 includes two portions 44 and 46. In one channel, one portion 44 is 20% of the length of the channel and the other portion 46 is the remaining 80% of the channel. The 80%–20% arrangement is reversed for adjacent channels, such that in one channel the cross-closure line 50 occurs at a 20% point from one end of the featherbed, i.e. end 48, while in the next adjacent channel the cross-closure line 50 occurs at an 80% point from the same end of the channel. The 80%–20% portion arrangement alternates across the width of the featherbed, as shown.

FIG. 2B shows a similar arrangement for a featherbed with lateral (side-to-side) channels 58. The position of the line of stitching 60 will alternate from 80%–20% to 20%–80% for adjacent channels top 61 to bottom 63 of the featherbed.

Other stitching arrangements can also be made, i.e. other cross-closing alternating position can be used. FIG. 3A shows a stitching arrangement for a featherbed 68 with vertical channels 70—70, in which the cross-closure line of stitching 71—71 alternates between ⅓ and ⅔ channel length positions for successive channels, with each line of stitching dividing a channel into two portions, like the embodiment of FIGS. 2A and 2B. The same arrangement is shown for a featherbed 72, shown in FIG. 3B, with lateral channels 74—74 and cross-closure stitching lines 73—73.

Still other arrangements include alternating 70%–30% or 60%–40% arrangements or other arrangements. The key advantage in all of these arrangements is the alternating position of the cross-closure line of stitching on successive channels.

It should be understood that the arrangement of the stitching position can be varied within one article. For instance, a plurality of channels could have a 50%–50% position arrangement, while other channels have a 60%–40% arrangement or a ⅔–⅓ arrangement, all alternating (reversing), as well as others. The change in the position of the line of stitching could have a pattern or could be random.

Figure 4:
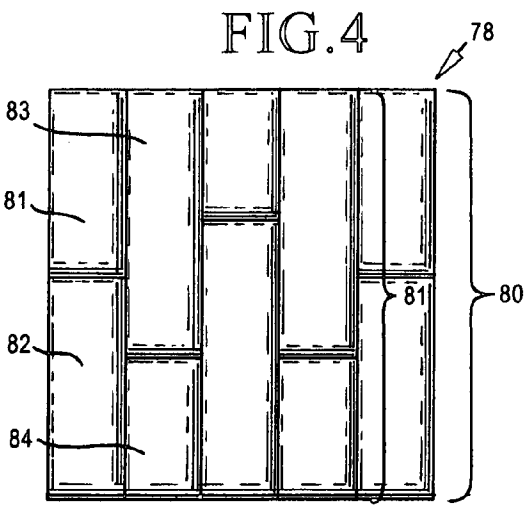
FIG. 4 shows an embodiments with a combination of a 50%–50% and ⅔–⅓ alternating arrangement.

Such an arrangement is shown in FIG. 4 in which a featherbed 78 has successive adjacent channels, e.g. channels 80 and 81, with the channel construction shown as an alternating combination between a 50%–50% arrangement (for example, portions 81, 82 for one channel) and a ⅔–⅓ arrangement (for example, portions 83, 84) for an adjacent channel. This change in cross-closure stitching arrangement combination, however, is one example only; other cross-closure sewing arrangement combinations can be used.

Figure 5A:
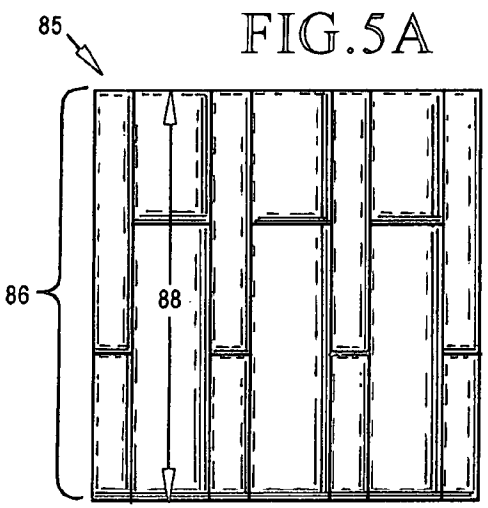
FIGS. 5A and 5B show embodiment with alternating channel widths with a 70%–30% alternating channel length construction.
Figure 8:
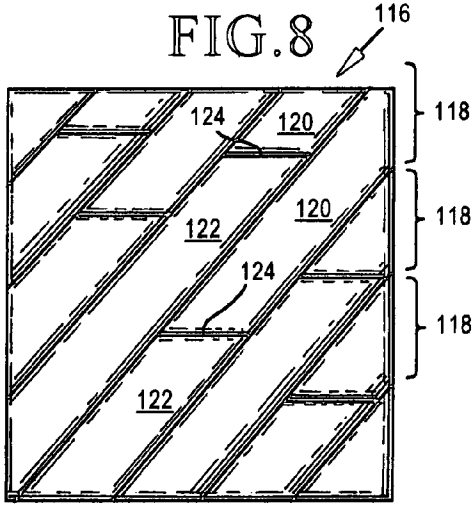
FIG. 8 shows a diagonal "Z" channel arrangement, with an alternating channel construction.
Figure 5B:
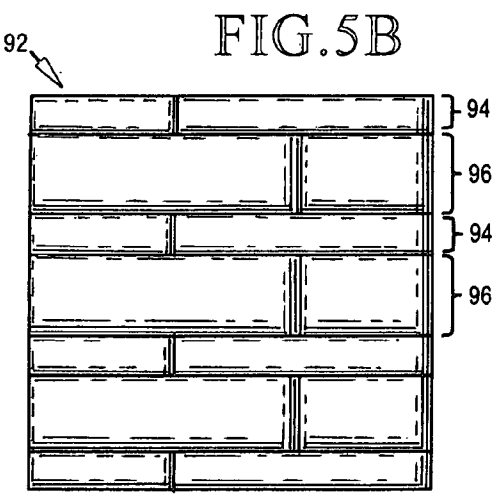

In addition, the channels of the bedding article do not have to have the same width. The channels could alternate, for instance, between 4-inch and 6-inch widths or between 5-inch and 7-inch widths, as well as other combinations. This arrangement is shown in FIGS. 5A and 5B. FIG. 5A shows a featherbed 85 with vertical channels 86 of one width alternating with vertical channels 88 of another width. As indicated above, various combinations of widths can be used. While two widths are shown in FIG. 5A, more than two widths can be used. The widths can be varied in a regular pattern or can be varied without a pattern. FIG. 5B shows a similar arrangement with lateral channels. Featherbed 92 includes channels 94 of one width alternating with channels 96 of another width.

In both FIGS. 5A and 5B, the position of the cross-closure stitching is an alternating ⅔–⅓pattern. This pattern can also be varied, with other combinations, including 50%–50% and 60%–40%, for example, as well as other combinations.

Figure 6:
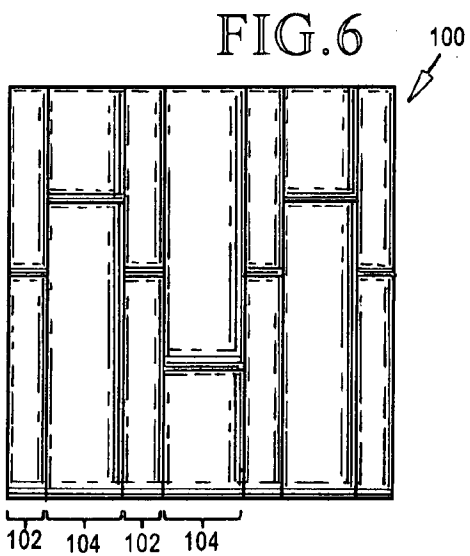
FIG. 6 shows another embodiment combining alternate channel width and alternating channel construction between 50%–50% and 70%–30%.

FIG. 6 is similar to the arrangement of FIG. 5A, with featherbed 100 having vertical channels of alternating widths 102 and 104. However, in FIG. 6, the position of the cross-closure stitching in successive channels will also vary. For instance, in FIG. 6, the stitching arrangement varies between 50%–50% and 70%–30%, with the narrow channels 102 having a 50%–50% arrangement and the wider channels 104 having an alternating 70%–30% arrangement. Other combinations of channel widths and cross-closure stitch positions can be used.

Figure 7:
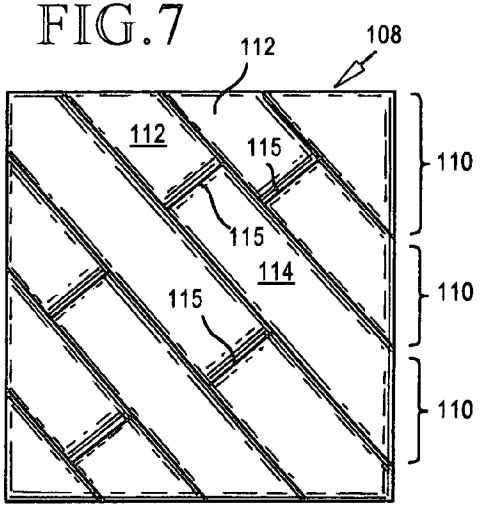
FIG. 7 shows a diagonal "T" channel arrangement, with an alternating channel construction.

FIGS. 7A and 7B show the channel construction of the present invention with a diagonal pattern, as opposed to either a longitudinal or lateral arrangement of the channels. In FIG. 7A, featherbed 108 includes a plurality of channels 110—110 running diagonally of the featherbed. Each diagonal channel 110 is sewn to form two portions 112 and 114. The length of the portions may vary, as discussed above, in various combinations. The cross-closure lines 115 in FIG. 7A are at a right angle to the channels (a "T" pattern). FIG. 7B also shows diagonal channels. Featherbed 116 includes a plurality of diagonal channel arrangement 118. Each channel is divided into two portions 120 and 122, although in this case, the line of stitching dividing 124 each channel is parallel with the lateral direction of the featherbed instead of perpendicular to the channels. This results in a "Z" shaped pattern.

The above examples all illustrate the basic principle of the present invention in which a featherbed or similar bedding product is divided into a series of adjacent channels. The adjacent channels are separated into two portions by a line of stitching or other closure. When the two portions are of different lengths, and the lengths alternate between adjacent channels, many advantages result, including as indicated above a significant reduction in shifting of the feathers during use, thereby improving performance and reducing the action required to maintain the bedding product in a "fluffed" condition.

The construction shown herein can be used with any fill which is to be blown into the body of a featherbed, including down, polyester cluster fiberfill, polyester fiberfill or short length polyester fiberfill.

Although a preferred embodiment of the invention has been described herein for purposes of illustration, it should be understood that various changes, modifications and substitutions may be incorporated in the embodiment without departing from the spirit of the invention, which is defined by the claims which follow.

What is claimed is:

1. A bedding article, comprising:

a plurality of bedding channels into which fill can be blown, wherein at least a majority of the channels are divided into just two longitudinal portions of different lengths by a closing element, wherein each said longitudinal portion is open along its entire length to receive filling therein and wherein the lengths of each of the two longitudinal portions, respectively, vary between adjacent channels, such that the portions overlap longitudinally between adjacent channels; and filling in the two portions of each channel.

2. The article of claim 1, wherein the plurality of channels extend longitudinally of the bedding article.

3. The article of claim 1, wherein the plurality of channels extend laterally of the bedding article.

4. The article of claim 1, wherein the different lengths are in the range of 60%–90% for one length and 40%–10% for the other length, each pair of lengths adding to 100%, and wherein the different lengths alternate between adjacent channels.

5. The article of claim 4, wherein the different lengths are 70% and 30%.

6. The article of claim 4, wherein the different lengths are 80%–20%.

7. The article of claim 4, wherein the different lengths are ⅔–⅓.

8. The article of claim 4, wherein the different lengths are 60%–40%.

9. The article of claim 1, wherein the width of the channels vary.

10. The article of claim 9, wherein the width of the channels vary according to a preselected pattern.

11. The article of claim 1, wherein the channels extend at a diagonal relative to the longitudinal direction of the bedding article.

12. The article of claim 1, wherein the bedding article is a featherbed.

* * * * *